US009869149B2

(12) United States Patent
Al-Badran

(10) Patent No.: US 9,869,149 B2
(45) Date of Patent: Jan. 16, 2018

(54) SCISSOR-MECHANISM CLOSING RAMS OF BLOW OUT PREVENTORS

(71) Applicant: Saudi Arabian Oil Company, Dhahran (SA)

(72) Inventor: Mohammed Saud Al-Badran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 441 days.

(21) Appl. No.: 14/499,833

(22) Filed: Sep. 29, 2014

(65) Prior Publication Data

US 2016/0090809 A1 Mar. 31, 2016

(51) Int. Cl.
*E21B 33/06* (2006.01)

(52) U.S. Cl.
CPC ..... *E21B 33/061* (2013.01)

(58) Field of Classification Search
CPC .... E21B 33/06; E21B 33/061; E21B 33/0385; E21B 29/08; E21B 34/06
See application file for complete search history.

(56) References Cited

U.S. PATENT DOCUMENTS 1,565,718 A * 12/1925 Dorman ..... E21B 33/061 138/46
3,554,480 A * 1/1971 Rowe ..... E21B 33/062 251/1.3
6,244,336 B1 6/2001 Kachich
6,877,712 B2 4/2005 Wiedemann
7,051,989 B2 5/2006 Springett et al.
7,243,713 B2 7/2007 Isaacks et al.
8,662,183 B1 3/2014 Vickio, Jr.
2004/0108010 A1 6/2004 Gaston et al.
2010/0051847 A1 3/2010 Mailand et al.
2011/0030943 A1 2/2011 Le et al.
2012/0073815 A1 3/2012 Springett et al.
2012/0216901 A1 8/2012 Dickinson
(Continued)

FOREIGN PATENT DOCUMENTS

JP 54109624 A 8/1979

OTHER PUBLICATIONS

PCT International Search Report and The Written Opinion of the International Searching Authority dated Jan. 22, 2016; International Application No. PCT/US2015/052590; International Filing Date: Sep. 28, 2015.

(Continued)

*Primary Examiner* — Nicole Coy
*Assistant Examiner* — Brandon Duck
(74) *Attorney, Agent, or Firm* — Bracewell LLP; Constance Gall Rhebergen; Linda L. Morgan

(57) ABSTRACT

A ram closing assembly for a blowout preventor has a main central bore and a radial bore normal to the main central bore and includes a ram body having a rotational pin proximate to an inner end. A pair of ram arm assemblies are located on opposite sides of the ram body. The ram arm assemblies have a shaped end and an elbow end. A rotating ram is pivotally connected to the rotational pin and to the elbow end of one of the ram arm assemblies. A ram actuator is movable relative to the ram body, to move the pair of ram arm assemblies to pivot the rotating rams about the rotational pin to a closed position.

17 Claims, 3 Drawing Sheets

(56) References Cited

U.S. PATENT DOCUMENTS

| | | | |
|---|---|---|---|
| 2013/0126030 | A1 | 5/2013 | Green |
| 2013/0153241 | A1 | 6/2013 | Mallinson et al. |
| 2014/0209320 | A1 | 7/2014 | Le et al. |

OTHER PUBLICATIONS

The International Search Report and Written Opinion for related PCT application PCT/US2017/016158 dated Apr. 12, 2017.

* cited by examiner

SCISSOR-MECHANISM CLOSING RAMS OF BLOW OUT PREVENTORS

BACKGROUND OF THE INVENTION

1. Field of the Invention

The present invention relates generally to wellhead blowout preventors, and more particularly to systems and methods for closing the rams of a blowout preventor.

2. Description of the Related Art

Blowout preventors are a part of wellhead assemblies associated with drilling and workover of subterranean wells, and in particular to hydrocarbon subterranean wells. Some blowout preventors seal across as central bore of the wellhead assembly, either around a tubular member that extends through the wellhead assembly, or across an open central bore where no tubular member extends through the wellhead assembly. For example, during drilling operations, the drill string is sealed to prevent damage to the well and associated equipment. The blowout preventor can be used to control unexpected well bore spikes to form a tight seal around the drill string until the well bore pressure can be returned to normal operating levels. The blowout preventor can also be used to seal around the drill pipe during stripping operations when the drill pipe is pulled from the wellbore. In a pumping production wellhead assembly, the blowout preventor may be configured to seal against a polished rod or a tubular member, if present. In other applications, a blowout preventor can be used to grip and hold, or to shear through, a tubular member that extends through the wellhead assembly.

In current blowout preventors, opposing rams move radially across the central bore and have faces that meet and seal across the central bore. Blind blowout preventor rams seal against each other across the central bore when no vertical tubular member is in place. The rams can be hydraulically actuated or can be moved with a hand crank or other mechanical or manual means. These current blowout preventors can be large and cumbersome due to the radial bores that extend outward on opposite sides of the blowout preventors for housing the radially moving rams and the ram actuation means.

SUMMARY OF THE DISCLOSURE

Embodiments of the present disclosure provide systems and methods for closing a ram of a blowout preventor that requires less space than conventional blowout preventors. Embodiments of this disclosure include rotational rams that are operated from only one side of the blowout preventor. The blowout preventor of this disclosure can be of various sizes, and can be suitable, for example, for large shear rams for controlling disastrous well control incidents. Because of the relatively smaller blowout preventor assembly, embodiments of the blowout preventor of this disclosure are also well suited for mobile blowout preventor units and for other small blowout preventor applications, such as shutting off a leaking valve.

In an embodiment of this disclosure a ram closing assembly for a blowout preventor having a main central bore and a radial bore normal to the main central bore, includes a ram body having a rotational pin proximate to an inner end. A pair of ram arm assemblies are located on opposite sides of the ram body. The ram arm assemblies have a shaped end and an elbow end. The ram closing assembly also includes a pair of rotating rams, each rotating ram being pivotally connected to the rotational pin and to the elbow end of one of the ram arm assemblies. A ram actuator is radially movable relative to the ram body, to move the pair of ram arm assemblies to pivot the rotating rams about the rotational pin between an open position and a closed position.

In alternate embodiments, the ram closing assembly includes a bearing located between, and engaging both, the shaped end of one of the ram arm assemblies and the ram actuator. The shaped surface can have a curved profile engaging the bearing as the rotating rams move between the open position and the closed position. The ram body can be radially fixed relative to the wellhead blowout preventor. A piston rod can be secured to the ram actuator, the piston rod extending radially through an opening and into a piston chamber at a radial outer end of the radial bore.

In other alternate embodiments, in the closed position, the rotating rams can be located across the main central bore and sealingly engage a top surface and a bottom surface of the radial bore around the circumference of the main central bore. The elbow end can have an elbow pin and the ram arm assemblies can be secured to the elbow end at the elbow pin.

In an alternate embodiment of this disclosure, a blowout preventor includes a blowout preventor body having a main central bore and a radial bore normal to the main central bore. A ram body is located in the radial bore, the ram body having a rotational pin proximate to a radially inner end. A pair of ram arm assemblies are located on opposite sides of the ram body. The ram arm assemblies have an elbow end at a radially inner end, and a shaped end opposite the elbow end. The blowout preventor includes a pair of rotating rams, each rotating ram pivotally connected to the rotational pin and to an elbow pin of the elbow end of one of the ram arm assemblies. A ram actuator is movable along the radial bore to pivot the rotating rams about the rotational pin between an open position and a closed position.

In alternate embodiments, the ram actuator moves the shaped end outward to pivot the rotating rams about the rotational pin towards a closed position. A piston chamber can be located at a radially outer end of a radial bore and a piston member can be located within the piston chamber. A piston rod can extend through an opening in a section wall of the radial bore. The piston rod can have a first end attached to the ram actuator and a second end attached to the piston member. A pressure media can be injected in a radially outward side of the piston chamber and move the rotating ram towards the closed position. The pressure media can be injected into a radially inward side of the piston chamber to move the rotating ram towards the open position.

In other alternate embodiments, the ram body is radially fixed within the radial bore and the elbow pin is moveable relative to the rotational pin. A bearing can be located between, and engaging both, the shaped end of one of the ram arm assemblies and the ram actuator. The shaped surface can have a curved profile engaging the bearing as the rotating rams move between the open position and the closed position. The rotating rams can have an inner insert such as a seal member, a cutting member or a gripping member. An arc shaped seal can be located on a top surface of each rotating ram and on a bottom surface of each rotating ram. When the rotating arms are in the closed position the arc shaped seals can form a ring and seal around the circumference of the main central bore.

In yet another embodiment of the current disclosure, a method for moving a ram of a blowout preventor between an open position and a closed position includes positioning a ram closing assembly in a radial bore of the blowout preventor. The ram closing assembly has a ram body with a rotational pin proximate to an inner end, a pair of ram arm assemblies located on opposite sides of the ram body, a pair of rotating rams, and a ram actuator. A pressure media can be injected into an outward side of a piston chamber located at a radially outer end of the radial bore, to cause the ram actuator to move radially inward and pivot the rotating rams about the rotational pin towards the closed position. A function can be performed with the rotating rams, such as sealing around a tubular member extending axially through the blowout preventor, cutting the tubular member, gripping the tubular member, or sealing across an open central bore of the blowout preventor. The reverse function can be performed with the rotating rams to open them.

In alternate embodiments, the pressure media can be injected into an inward side of the piston chamber to cause the ram actuator to move radially outward and pivot the rotating rams about the rotational pin towards the open position.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
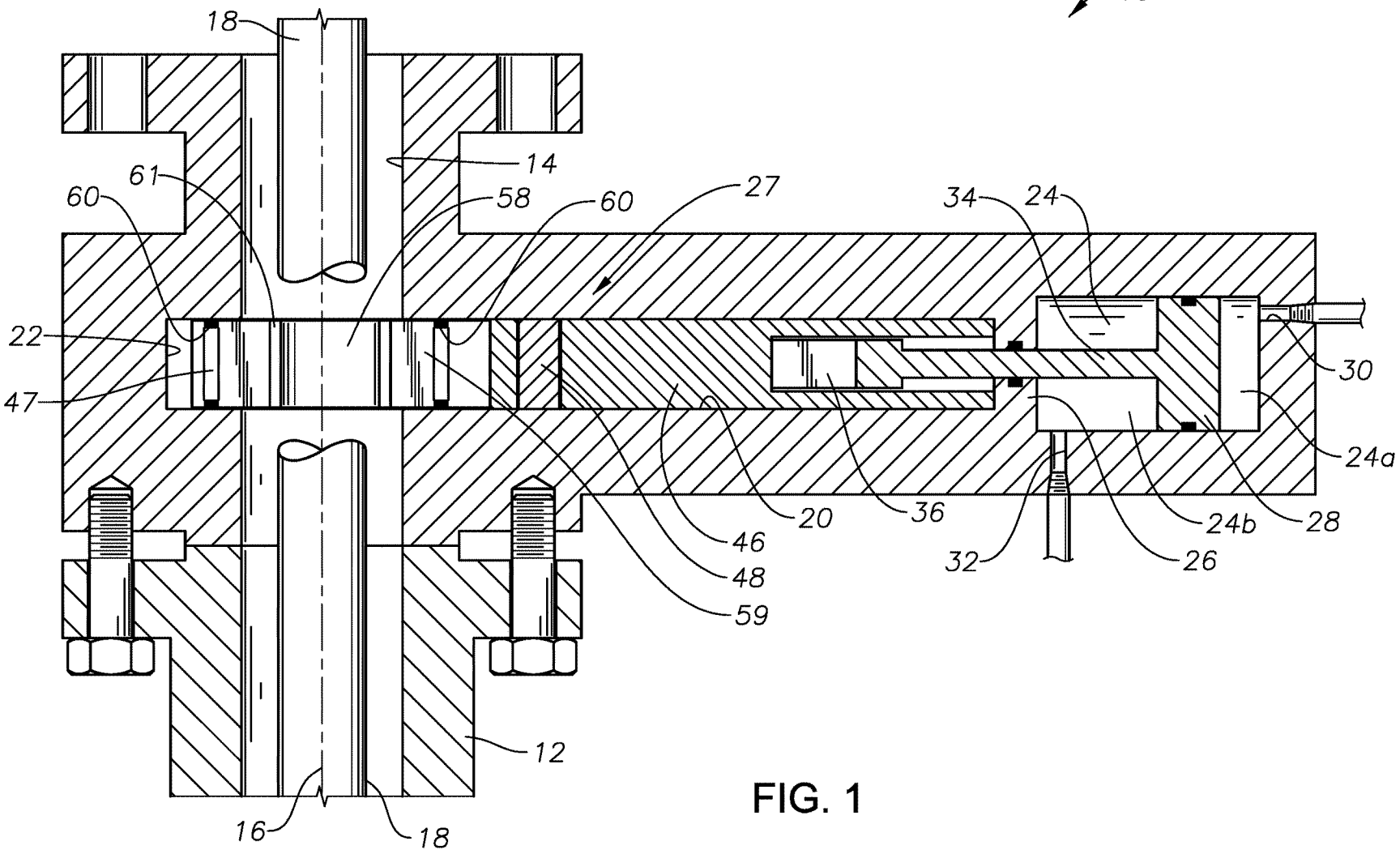
FIG. 1 is a section view of a blowout preventor with a ram closing device in accordance with an embodiment of this disclosure, shown with the rotating rams in the open position.

Referring to FIG. 1, a blowout preventor 10 is shown attached to a wellhead assembly 12 located above a subterranean well (not shown). Blowout preventor 10 can have a flange or bolting profile at an upper end for connecting another wellhead member to the top of blowout preventor 10, and a flange or bolting profile at a lower end for connecting another wellhead member to the bottom of blowout preventor 10. Blowout preventor 10 can be one in a series of blowout preventors of a blowout preventor stack. As an example, the blowout preventor stack can include three ram style blowout preventors and an annular style blowout preventor. Blowout preventor 10 has a main central bore 14 with an axis 16. Main central bore has a circular cross section. In certain embodiments, a tubular member 18 extends through main central bore 14. Tubular member 18 can be, for example, a drill pipe, a conductor pipe conveying fluids into or out of subterranean well, or a polished rod. In other embodiments, there is no tubular member 18 extending through main central bore 14.

Figure 2:
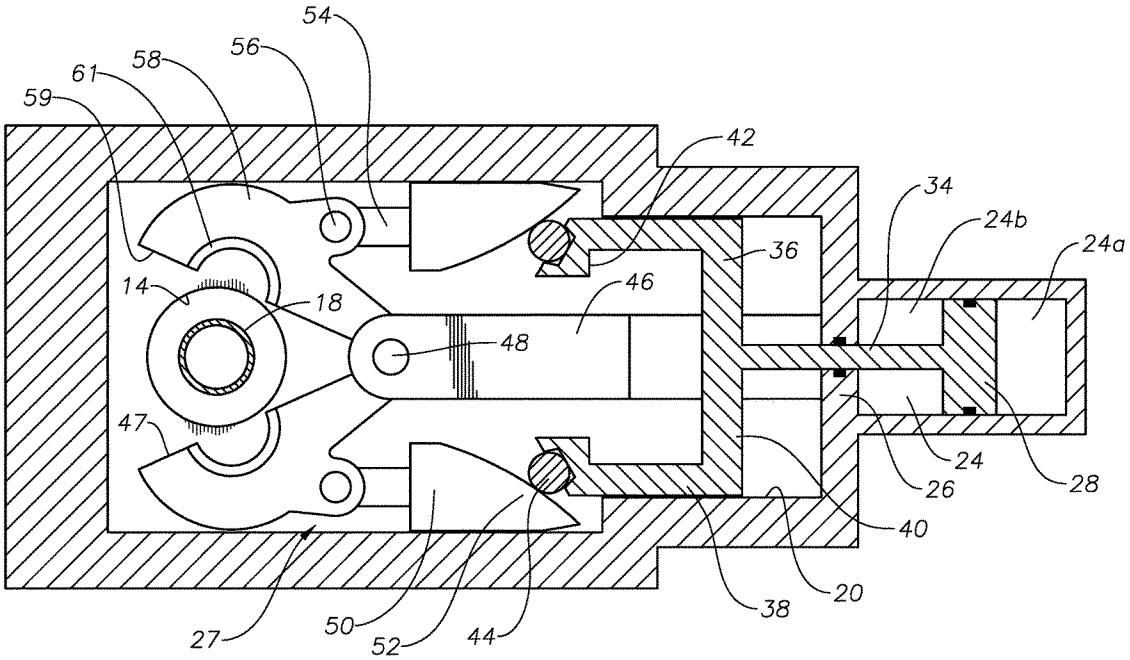
FIG. 2 is a section plan view of the ram closing device of FIG. 1, shown with the rotating rams in the open position.
Figure 3:
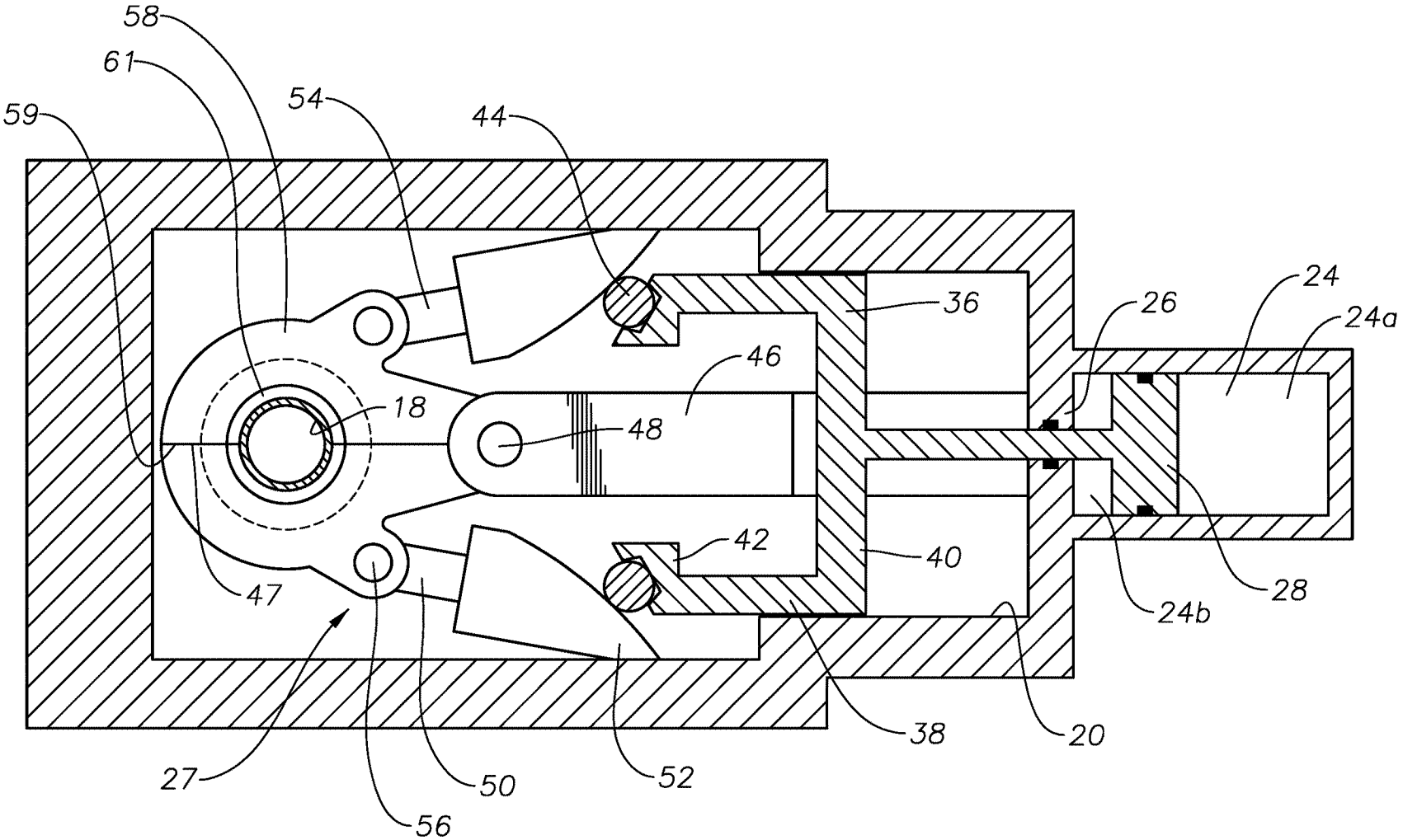
FIG. 3 is a section plan view of the ram closing device of FIG. 1, shown with the rotating rams in the closed position.

Looking at FIGS. 1-3, radial bore 20 extends from main central bore 14 in a direction generally normal to main central bore 14. Radial bore 20 can have a rectangular shaped cross section, with an axial height less than a width. A width of radial bore 20 can vary along its radial length, so that the width of radial bore 20 is largest adjacent to main central bore 14. Radial groove 22 is located in a sidewall of wellhead assembly 12 opposite radial bore 20. Radial groove 22 can have the same cross section as radial bore 20.

Piston chamber 24 is located at a radially outer end of radial bore 20. Piston chamber 24 is separated from radial bore 20 by section wall 26 that extends across the radial bore 20. Piston chamber 24 can have a circular cross section that has an inner diameter smaller than the width of piston chamber 24. Ram closing assembly 27 includes piston member 28 that is located within piston chamber 24. Piston member 28 sealingly engages the inner diameter of radial bore 20 and separates piston chamber 24 into a radially outward side 24*a* and a radially inward side 24*b*. A first inlet port 30 extends through a wall of piston chamber 24 and into the radially outward side 24*a*. A second inlet port 32 extends through a wall of piston chamber 24 and into the radially inward side 24*b*. Piston member 28 can move radially along piston chamber 24 in response to pressure media injected into inlet ports 30, 32. The pressure media can be hydraulic oil supplied by a rig accumulator and pumped by an electric pump.

Piston rod 34 extends through an opening in section wall 26. Piston rod 34 has a first end attached to ram actuator 36 and a second end attached to piston member 28. Piston rod 34 can be an elongated member with a circular cross section. An annular seal can be located within the opening in section wall 26 to seal between piston rod 34 and section wall 26.

Ram actuator 36 is located within radial bore 20 and is movable along radial bore 20. Ram actuator 36 can be generally u-shaped with two radially extending actuator arms 38 that are joined together at a base 40. Base 40 is shown perpendicular to both radial bore 20 and main central bore 14. Actuator arms 38 are spaced apart such that outer sides of actuator arms 38 slidingly engage an inner surface of radial bore 20. Piston rod 34 is attached to ram actuator 36 at base 40. An end of each actuator arm 38 opposite base 40 has a lip 42. Lip 42 can have a profile for retaining bearing 44. Ram actuator 36 can have an axial height that is substantially similar to the height of radial bore 20.

Ram closing assembly 27 also includes ram body 46. Ram body 46 can have an axial height that is substantially similar to the height of radial bore 20. Ram body 46 has rotational pin 48 proximate to a radially inner end. Ram body 46 can have a cavity that extends the entire width of ram body 46 at a radially outer end for reciprocally receiving base 40 of ram actuator 36. Ram body 46 can be fixed within radial bore 20 so that ram body 46 does not move relative to radial bore 20. Ram body 46 can, for example, be fixed to section wall 26. Ram actuator 36 is moveable relative to ram body 46.

A pair of ram arm assemblies 50 are located on opposite sides of ram body 46. Ram arm assemblies 50 have a shaped end 52 and an elbow end 54. Shaped end 52 of each ram arm assembly 50 has a shaped surface with a curved profile that engages one of the bearings 44, so that bearing 44 is located between, and engages both, shaped end 52 and the profile on lip 42 of ram actuator 36. Elbow end 54 has elbow pin 56, which is a rotational joining member. With ram body 46 and rotational pin 48 radially fixed within radial bore 20, elbow pin 56 is moveable relative to rotational pin 48, when ram actuator 36 moves radially within radial bore 20.

Ram closing assembly 27 has a pair of rotating rams 58. Rotating rams 58 have a general C shape with inner surfaces 59 that meet when rotating rams 58 are in a closed position. In the open position, inner surfaces 59 are angled relative to each other. An end of each rotating ram 58 is pivotally connected to rotational pin 48. Each rotating ram 58 is also pivotally connected to elbow pin 56 of elbow end 54 of one of the ram arm assemblies 50. Rotating rams 58 can move between an open position (FIGS. 1-2) and a closed position (FIG. 3). In the closed position, rotating rams 58 are located across main central bore 14 and sealingly engage a top surface and a bottom surface of radial bore 20 around the circumference of main central bore 14. Ram face ends have vertical seals 47 to seal between ram face ends when ram face ends meet.

Rotating rams 58 have an axial height that is marginally smaller than the height of radial bore 20 so that rotating arms can fit within radial bore 20 and can be sealed against radial bore 20. An arc shaped seal 60 is located on a top surface of each rotating ram 58 and on a bottom surface of each rotating ram 58. Arc shaped seals 60 located on the top surface of each rotating ram 58 engage and seal against a downward facing surface of radial bore 20 and a downward facing surface of radial groove 22. Arc shaped seals 60 located on the bottom surface of each rotating ram 58 engage and seal against an upward facing surface of radial bore 20 and an upward facing surface of radial groove 22. When rotating rams 58 are in the closed position the arc shaped seals 60 form a ring and seal entirely around the circumference of main central bore 14 to prevent fluids and pressure from passing by rotating rams 58 between the surfaces of rotating rams 58 and radial bore 20.

In the open position, ends of rotating rams 58 opposite rotational pin 48 extend into radial groove 22. Rotating rams 58 have an inner insert 61. Inner insert 61 can be located within the inner curve of rotating rams 58. Inner insert 61 can be a seal member shaped to accommodate tubular member 18, a seal member shaped to seal across main central bore 14 when there is no tubular member 18, a cutting or shearing member or a gripping member. Inner insert 61 can be, for example a half-moon shaped seal.

In an example of operation, the ram closing assembly 27 is positioned in radial bore 20 of the blowout preventor 10. A pressure media can be injected through first inlet port 30 and into the outward side 24*a* of a piston chamber 24, to cause piston member 28 to move radially inward resulting in ram actuator 36 moving radially inward. The curved profile of shaped end 52 of ram arm assemblies 50 engage bearing 44 and cause bearing 44 to travel along the curved profile of shaped end 52, causing a tip of shaped end 52 of ram arm assembly 50 to rotate outward. The outward rotation of shaped end 52 of ram arm assembly 50 causes rotating rams 58 to pivot around rotational pin 48 and move rotating rams 58 between the open position and the closed position.

With the rotational rams 58 moving towards, or being in, the closed position, rotating rams 58 can seal around tubular member 18 extending axially through main central bore 14, can shear tubular member 18, or can grip tubular member 18. In alternate embodiments, with rotational rams 58 in the closed position, rotating rams 58 can seal across an open main central bore 14 when there is no tubular member 18.

In order to re-open the blowout preventor and move rotating rams 58 towards an open position, pressure media can be injected into an inward side 24*b* piston chamber 24 to cause the ram actuator 36 to move radially outward and pivot the rotating rams 58 about rotational pin 48 towards the open position.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A ram closing assembly for a blowout preventor having a main central bore and a radial bore normal to the main central bore, the ram closing assembly comprising:

a ram body having a rotational pin at an inner end;

a pair of ram arm assemblies with one ram arm assembly located on one side of the ram body and a second ram arm assembly located on opposite side of the ram body, each of the ram arm assemblies having a first end and a second end, wherein the first end of each ram arm assembly has a curved outer surface on a side facing the opposite ram arm assembly;

a pair of rotating rams, each rotating ram pivotally connected to the rotational pin and to the second end of one of the ram arm assemblies;

a ram actuator engaging the first end of each of the ram arm assemblies and movable relative to the ram body to move the pair of ram arm assemblies to pivot the rotating rams about the rotational pin to a closed position;

a bearing located between the curved outer surface of the first end of one of the ram arm assemblies and the ram actuator, the bearing engaging and movable along the curved outer surface; and a piston rod secured to the ram actuator, the piston rod extending radially through an opening and into a piston chamber at a radial outer end of the radial bore, the piston rod moveable linearly relative to the ram body and linearly fixed to the ram actuator; wherein engagement of the ram actuator with the first end of the pair of ram arm assemblies converts linear movement of the piston rod to rotational movement of the rotating rams.

2. The ram closing assembly according to claim 1, wherein the ram body is radially fixed relative to the blowout preventor.

3. The ram closing assembly according to claim 1, wherein in the closed position the rotating rams are located across the main central bore and sealingly engage a top surface and a bottom surface of the radial bore around a circumference of the main central bore.

4. The ram closing assembly according to claim 1, wherein the second end of each of the ram arm assemblies has an elbow pin and one of the rotating rams is secured to one of the second ends at one of the elbow pins, and the other of the rotating rams is secured to the other of the second ends at the other of the elbow pins.

5. The ram closing assembly according to claim 1, wherein there is no more than one piston rod and the piston rod moves each of the rotating rams to the closed position.

6. The ram closing assembly according to claim 1, wherein the rotating rams are rotatable between the closed position and an open position.

7. The ram closing assembly according to claim 1, wherein the ram actuator is spaced apart from the rotating rams and spaced apart from the piston chamber.

8. The ram closing assembly according to claim 1, wherein a base of the ram actuator is located within a cavity of the ram body.

9. A blowout preventor, comprising:

a blowout preventor body having a main central bore and a radial bore normal to the main central bore;

a ram body located in the radial bore, the ram body having a rotational pin at a radially inner end;

a pair of ram arm assemblies with one ram arm assembly located on one side of the ram body and a second ram arm assembly located on opposite side of the ram body, each of the ram arm assemblies having a second end at a radially inner end and a first end opposite the second end, wherein the first end of each ram arm assembly has a curved outer surface on a side facing the opposite ram arm assembly;

a pair of rotating rams, each rotating ram pivotally connected to the rotational pin and to an elbow pin of the second end of one of the ram arm assemblies;

a ram actuator engaging the first end of the pair of ram arm assemblies and movable along the radial bore to pivot the rotating rams about the rotational pin between an open position and a closed position;

a bearing located between the curved outer surface of the first end of one of the ram arm assemblies and the ram actuator, the bearing engaging and moveable along the curved outer surface; and a piston rod secured to the ram actuator, the piston rod extending radially through an opening and into a piston chamber at a radial outer end of the radial bore, the piston rod moveable linearly relative to the ram body and linearly fixed to the ram actuator; wherein the engagement of the ram actuator with the first end of the pair of ram arm assemblies converts linear movement of the piston rod to rotational movement of the rotating rams.

10. The blowout preventor according to claim 9, wherein the ram actuator rotates the first end so that each of the elbow pins move relative to the rotational pin to pivot the rotating rams about the rotational pin towards the closed position.

11. The blowout preventor according to claim 9, further comprising:

a piston chamber located at a radially outer end of a radial bore;

a piston member located within the piston chamber; wherein the piston rod has a first end attached to the ram actuator and a second end attached to the piston member; and wherein a pressure media injected in a radially outward side of the piston chamber moves the rotating ram towards the closed position, and the pressure media injected into a radially inward side of the piston chamber moves the rotating ram towards the open position.

12. The blowout preventor according to claim 9, wherein the ram body is radially fixed relative within the radial bore and the elbow pin is moveable relative to the rotational pin.

13. The blowout preventor according to claim 9, wherein the rotating rams have an inner insert selected from a group consisting of a seal member, a cutting member and a gripping member.

14. The blowout preventor according to claim 9, further comprising an arc shaped seal located on a top surface of each of the rotating rams and on a bottom surface of each of the rotating rams, and wherein when the rotating rams are in the closed position the arc shaped seals form a ring and seal around a circumference of the main central bore.

15. A method for moving a ram of a blowout preventor between an open position and a closed position, the method comprising:

positioning a ram closing assembly in a radial bore of the blowout preventor, the ram closing assembly having a ram body with a rotational pin at an inner end, a pair of ram arm assemblies with one ram arm assembly located on one side of the ram body and a second ram arm assembly located on opposite side of the ram body, a pair of rotating rams, and a ram actuator, the ram arm assemblies having a second end at a radially inner end and a first end opposite the second end, the first end of each ram arm assembly having a curved outer surface on a side facing the opposite ram arm assembly, and a bearing located between the curved outer surface of the first end of one of the ram arm assemblies and the ram actuator and engaging the curved outer surface;

injecting a pressure media into an outward side of a piston chamber located at a radially outer end of the radial bore, to move a piston rod that is linearly fixed to the ram actuator in a direction linearly relative to the ram body to cause the ram actuator to move radially inward, engaging the first end of the pair of ram arm assemblies with the bearing moving along the curved outer surface, and pivoting the rotating rams about the rotational pin towards the closed position; wherein engagement of the ram actuator with the first end of the pair of ram arm assemblies converts linear movement of the piston rod to rotational movement of the rotating rams.

16. The method according to claim 15, further comprising injecting the pressure media into an inward side of the piston chamber to cause the ram actuator to move radially outward and pivot the rotating rams about the rotational pin towards the open position.

17. The method according to claim 15, further comprising performing a function with the rotating rams, the function selected from a group consisting of sealing around a tubular member extending axially through the blowout preventor, cutting the tubular member, gripping the tubular member, and sealing across an open central bore of the blowout preventor.

* * * * *